US009240312B2

(12) United States Patent
Ito et al.

(10) Patent No.: US 9,240,312 B2
(45) Date of Patent: Jan. 19, 2016

(54) DISCHARGE LAMP AND LIGHT SOURCE DEVICE

(71) Applicant: HAMAMATSU PHOTONICS K.K., Hamamatsu-shi, Shizuoka (JP)

(72) Inventors: Masaki Ito, Hamamatsu (JP); Yoshinobu Ito, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 14/422,363

(22) PCT Filed: Jul. 18, 2013

(86) PCT No.: PCT/JP2013/069511
§ 371 (c)(1),
(2) Date: Feb. 19, 2015

(87) PCT Pub. No.: WO2014/030468
PCT Pub. Date: Feb. 27, 2014

(65) Prior Publication Data

US 2015/0243491 A1 Aug. 27, 2015

(30) Foreign Application Priority Data

Aug. 22, 2012 (JP) ..... 2012-183345

(51) Int. Cl.

| | |
|---|---|
| ***H01J 61/10*** | (2006.01) |
| ***H01J 61/68*** | (2006.01) |
| ***H01J 61/54*** | (2006.01) |
| ***H01J 61/067*** | (2006.01) |
| ***H01J 61/56*** | (2006.01) |
| ***H01J 61/52*** | (2006.01) |

(52) U.S. Cl.
CPC ..... *H01J 61/547* (2013.01); *H01J 61/0672* (2013.01); *H01J 61/526* (2013.01); *H01J 61/56* (2013.01)

(58) Field of Classification Search
CPC ..... H01J 65/00; H01J 61/10; H01J 61/68; H01J 61/30
USPC ..... 315/94, 200 R, 326; 313/634, 637
See application file for complete search history.

(56) References Cited

U.S. PATENT DOCUMENTS

2004/0021419 A1* 2/2004 Ito ..... H01J 61/10 313/637
2004/0046506 A1* 3/2004 Kawai ..... H01J 61/68 313/634

FOREIGN PATENT DOCUMENTS

JP H02-273452 A 11/1990
JP H06-060852 A 3/1994

(Continued)

OTHER PUBLICATIONS

English-language translation of International Preliminary Report on Patentability (IPRP) dated Mar. 5, 2015 that issued in WO Patent Application No. PCT/JP2013/069511.

*Primary Examiner* — Daniel D Chang
(74) *Attorney, Agent, or Firm* — Drinker Biddle & Reath LLP

(57) ABSTRACT

A discharge lamp includes a housing including a dielectric portion having a light transmission area formed of a dielectric material and transmitting light, and a main body portion forming a discharge-gas-filled space together with the dielectric portion, the discharge-gas-filled space being filled with a discharge gas; an electron emission source disposed in the discharge-gas-filled space to face the light transmission area; a discharge path limiting member separating the electron emission source and the light transmission area, in the discharge-gas-filled space, and including an electron passage hole that transmits electrons emitted from the electron emission source; and an external electrode disposed at an outer side of the housing to face the electron emission source across the dielectric portion, and including an opening that passes the light transmitted through the light transmission area.

10 Claims, 7 Drawing Sheets

(56) References Cited

FOREIGN PATENT DOCUMENTS

| | | | |
|---|---|---|---|
| JP | H09-190803 | A | 7/1997 |
| JP | 3385170 | B2 | 3/2003 |
| JP | 2005-519437 | A | 6/2005 |
| JP | 2007-335130 | A | 12/2007 |
| JP | 2008-108635 | A | 5/2008 |
| WO | WO-02/49072 | A1 | 6/2002 |

* cited by examiner 1A
73
Z
71
72
7
6A
61
62
51
52
5A
54
54
21a
41a
21
2
41
4
42
53
3
53
55
24
22
23
43
43
31
31
55

DISCHARGE LAMP AND LIGHT SOURCE DEVICE

TECHNICAL FIELD

The present invention relates to a discharge lamp and a light source device including the discharge lamp.

BACKGROUND ART

Conventionally, a discharge lamp in which discharge emission occurs in a discharge gas such as heavy hydrogen and light is emitted is known (for example, see Patent Literatures 1 to 4). For example, an electrodeless discharge lamp including a discharge container of which an internal space is filled with heavy hydrogen, a pair of electrodes attached to an outer surface of the discharge container to face each other across the internal space, and a diaphragm member that limits a portion through which electrons pass in the internal space is described in Patent Literature 1. An opening through which light passes is provided in the electrode that is an anode. In this electrodeless discharge lamp, induction discharge occurs in the internal space when a high-frequency current is supplied between the pair of electrodes. When the discharge converges in the diaphragm body, point-shaped light is generated and emitted from the opening of the anode.

CITATION LIST

Patent Literature

[Patent Literature 1]
Japanese Patent No. 3385170
[Patent Literature 2]
Japanese Unexamined Patent Application Publication (Translation of PCT Application) No. 2005-519437
[Patent Literature 3]
Japanese Patent Laid-Open Publication No. Hei 2-273452
[Patent Literature 4]
Japanese Patent Laid-Open Publication No. Hei 6-60852

SUMMARY OF INVENTION

Technical Problem

In the above-described electrodeless discharge lamp, since electron flow occurs in the discharge gas only through the induction discharge, an amount of electrons supplied to the internal space is not sufficient in comparison with supply power. Therefore, in some cases, sufficient current density is not obtained. If the sufficient current density is not obtained, a sufficient amount of light may not be obtained. Meanwhile, when the supply power is increased so as to obtain sufficient current density, problems related to a withstand voltage such as occurrence of creeping discharge between the electrodes may occur because the pair of electrodes are both attached to the outer surface of the discharge container. Therefore, it may be difficult to perform a stable operation.

An object of the present invention is to provide a discharge lamp and a light source device in which sufficient current density and high stability can be achieved.

Solution to Problem

A discharge lamp according to an aspect of the present invention includes a housing including a dielectric portion having a light transmission area formed of a dielectric material and transmitting light, and a main body portion forming a discharge-gas-filled space together with the dielectric portion, the discharge-gas-filled space being filled with a discharge gas; an electron emission source disposed in the discharge-gas-filled space to face the light transmission area; a discharge path limiting member separating the electron emission source and the light transmission area, in the discharge-gas-filled space, and including an electron passage hole that transmits electrons emitted from the electron emission source; and an external electrode disposed at an outer side of the housing to face the electron emission source across the dielectric portion, and including an opening that passes the light transmitted through the light transmission area.

A light source device according to an aspect of the present invention includes the above-described discharge lamp; and an AC power supply that supplies an AC current between the electron emission source and the external electrode.

In the discharge lamp and the light source device, since the electron emission source is disposed in the discharge-gas-filled space in the inner side of the housing, dielectric polarization occurs in the dielectric portion and discharge starts when an AC current is supplied between the electron emission source and the external electrode disposed at the outer side of the housing. Since a sufficient amount of electrons are emitted in the discharge gas from the electron emission source disposed in the discharge-gas-filled space, it is possible to obtain sufficient current density. Further, since a pair of electrodes are separately disposed in the inside and the outside of the housing, withstand voltage performance between the electrodes becomes high. Therefore, it is possible to perform a stable operation in which abnormal discharge does not occur.

The external electrode may be in contact with the dielectric portion. In this case, since dielectric polarization suitably occurs, a stable discharge state is maintained. Therefore, it is possible to perform a more stable operation.

The electron emission source may include a base that conducts an electric current; and an electron emitting portion provided on an outer surface of the base, and the electron emitting portion may be formed of an easily electron-emitting substance that emits electrons more easily than does a material forming the base. In this case, since electrons are emitted from the electron emitting portion formed of the easily electron-emitting substance, the electrons are more reliably emitted than when the electrons are emitted from the base. Therefore, it is possible to obtain more sufficient current density.

The discharge path limiting member may include a body portion and a lid portion provided around an electron emission source accommodation space that accommodates the electron emission source, the body portion may assume a wall shape surrounding the electron emission source when viewed from a direction in which the electron emission source and the light transmission area face one another, and the lid portion may be connected to an end portion on the light transmission area side of the body portion, and include the electron passage hole. In this case, the electrons emitted from the electron emitting portion are prevented from being incident on, for example, the main body portion of the housing. Therefore, it is possible to perform a more stable operation.

A protection member formed of a material having a higher melting point than a material forming the discharge path limiting member and including a through-hole may be included, and the protection member may be attached to the discharge path limiting member so that the through-hole and the electron passage hole communicate. In this case, a peripheral edge portion of the electron passage hole and the vicinity thereof that easily deteriorate due to discharge in the discharge path limiting member can be further protected by the protection member, and the discharge path is kept in a stable state. Therefore, it is possible to perform a more stable operation.

The discharge lamp may include a tubular portion connected to the discharge path limiting member, the inside of the tubular portion communicating with the electron passage hole, and the tubular portion may project toward the light transmission area or the electron emission source. In this case, higher current density can be obtained in the tubular portion.

The discharge lamp may include a cover fixed to the housing to cover the dielectric portion, and the external electrode may be interposed between the cover and the dielectric portion. In this case, the external electrode and the dielectric portion can be in close contact with each other, and a stable discharge state is maintained. Therefore, it is possible to perform a more stable operation.

The electron emission source may be a thermionic emission source that emits thermal electrons. In this case, since electrons can be suitably supplied, it is possible to perform a more stable operation.

A light source device may include the above-described discharge lamp; an AC power supply that supplies an AC current between the electron emission source and the external electrode; and a heating DC power supply that heats the electron emission source. In this case, since the electrons can be suitably supplied from the heated electron emission source, it is possible to perform a more stable operation.

Advantageous Effects of Invention

According to the present invention, it is possible to provide the discharge lamp and the light source device in which sufficient current density and high stability can be achieved.

DESCRIPTION OF EMBODIMENTS

Hereinafter, embodiments will be described in detail with reference to the drawings. Further, the same or corresponding elements are denoted with the same signs and a repeated description is omitted.

First Embodiment

Figure 1:
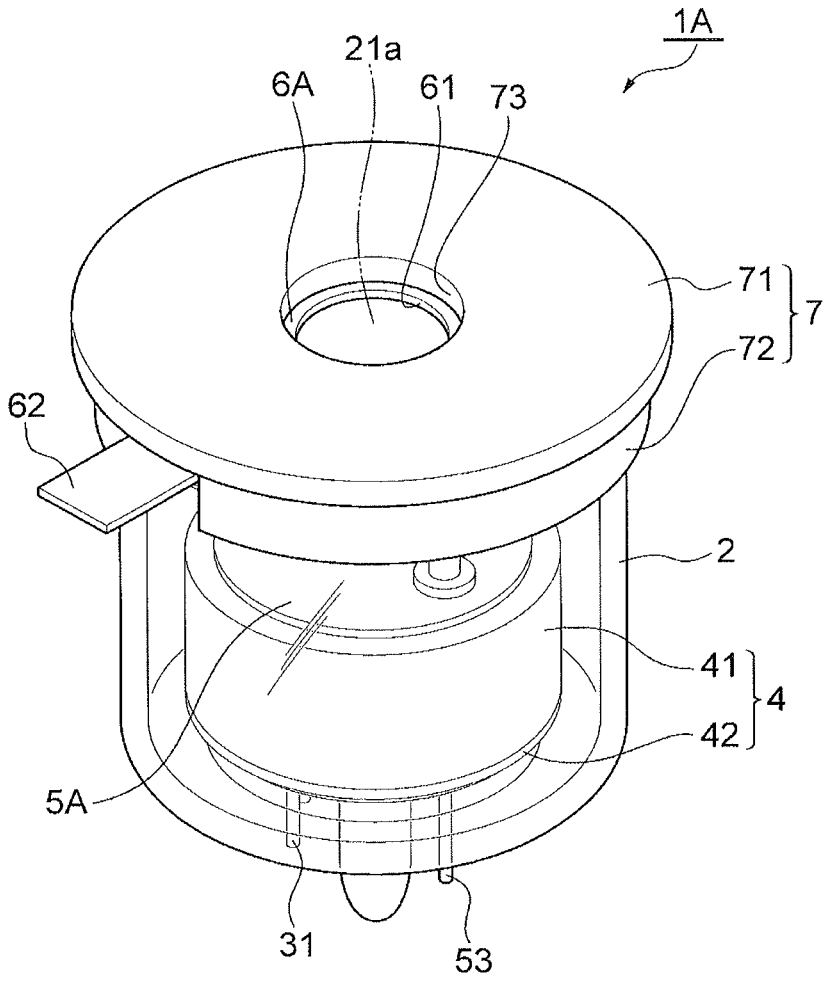
FIG. 1 is a perspective view illustrating a discharge lamp of a first embodiment.
Figure 2:
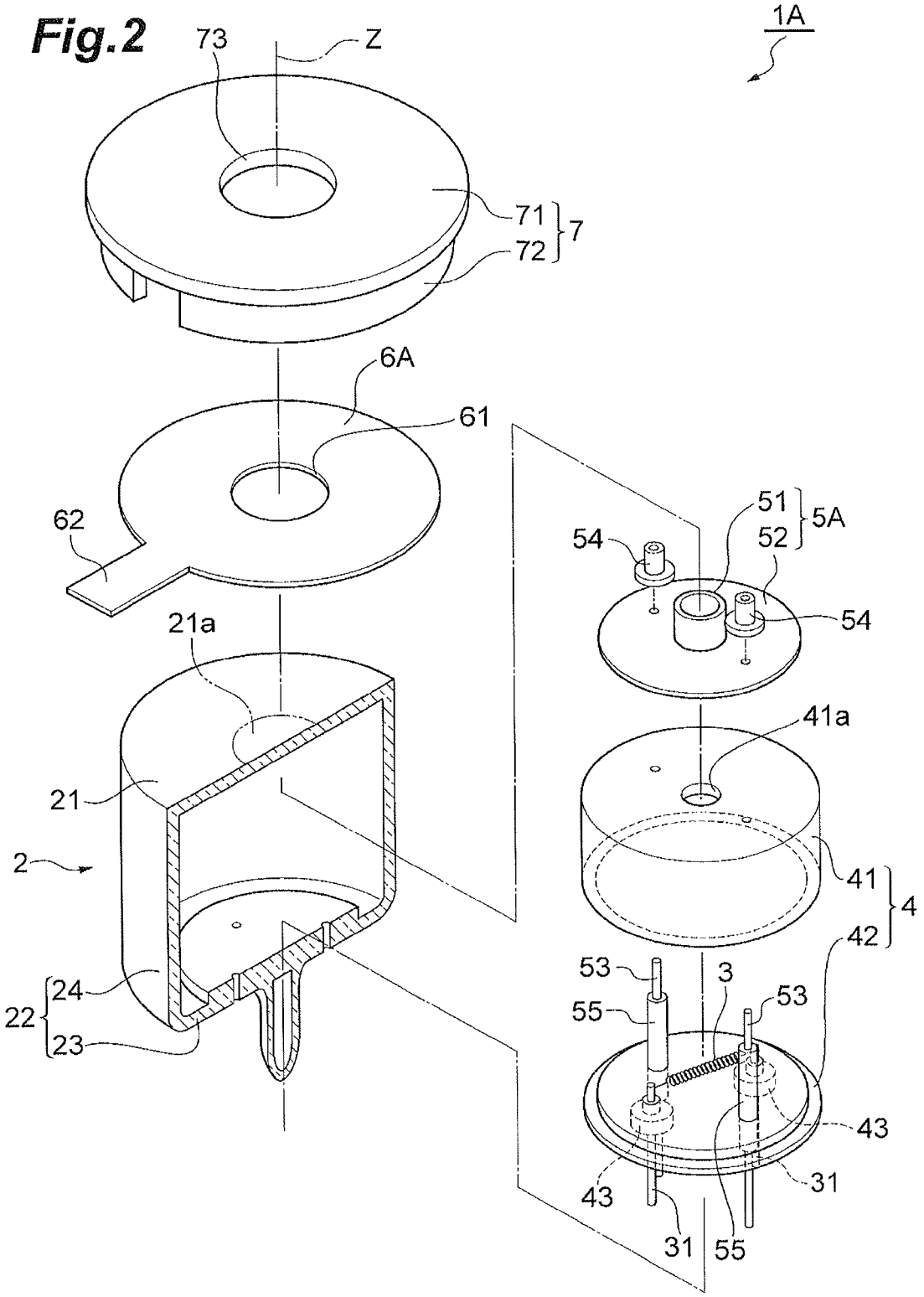
FIG. 2 is a partially cutaway exploded perspective view illustrating the discharge lamp of FIG. 1.

FIG. 1 is a perspective view illustrating a discharge lamp of a first embodiment, and FIG. 2 is a partially cutaway exploded perspective view illustrating the discharge lamp of FIG. 1. A discharge lamp 1A illustrated in FIGS. 1 and 2 is a light source that causes discharge emission in a discharge gas and emits light. The discharge lamp 1A includes a housing 2, an internal electrode 3, an electrode box 4, an aperture 5A, an external electrode 6A, and a cover 7.

The housing 2 is a container that contains the discharge gas. The inside of the housing 2 is a discharge-gas-filled space in which the discharge gas is filled. The discharge gas filled in the housing 2 is, for example, heavy hydrogen or xenon. Pressure (gas pressure) inside the housing 2 is, for example, about 100 to 10000 Pa. The housing 2 includes a tubular barrel portion 24, and a pair of circular plate-shaped lid portions that close both ends of the barrel portion 24. One of the lid portions constitutes a dielectric portion 21, and the other lid portion constitutes a stem portion 23 that holds power supply pins 31 (to be described below), and fixing pins 53 (to be described below). The barrel portion 24 and the stem portion 23 constitute a main body portion 22.

The dielectric portion 21 causes dielectric polarization and transmits the light generated inside the housing 2 to the outside. The dielectric portion 21 is formed of a dielectric material having a light transmission characteristic with respect to the light generated inside the housing 2. For example, the dielectric portion 21 is formed of any glass or ceramic. The dielectric portion 21 is a plate-shaped member, and assumes, for example, a circular plate shape. A predetermined area, including a substantially central portion, in the dielectric portion 21, that is, a circumferentially central area in the case of the circular plate-shaped dielectric portion 21, is a light transmission area 21*a* that is a light emission window through which the light generated in the discharge-gas-filled space is transmitted.

The main body portion 22 forms the discharge-gas-filled space together with the dielectric portion 21. The main body portion 22 is formed of an insulating material to which the dielectric portion 21 can be attached and, for example, is formed of any glass or ceramic. The main body portion 22 is integrally formed with the dielectric portion 21 to form a sealed space.

The internal electrode 3 is a thermionic emission source that emits thermal electrons to the discharge-gas-filled space, and functions as a hot cathode when the discharge occurs. The internal electrode 3 is disposed to face the light transmission area 21*a* in a position near the stem portion 23 in the discharge-gas-filled space.

For example, a filament is used as the internal electrode 3. The internal electrode 3 includes a base that conducts electric current, and an electron emitting portion provided in an outer peripheral surface of the base. The base extends in a spring shape. The base is formed of, for example, tungsten. The electron emitting portion is formed of an easily electron-emitting substance that emits electrons more easily than does a material forming the base. For example, barium oxide is used as the easily electron-emitting substance. The electron emitting portion is formed, for example, by applying the easily electron-emitting substance to the base. One ends of the power supply pins 31 and 31 are connected to both end portions of the internal electrode 3. Each of the two power supply pins 31 and 31 formed of a conductive member holds the internal electrode 3 in a predetermined spatial position inside the housing 2 at its one end. The other ends of the power supply pins 31 and 31 pass through a bottom lid 42 (to be described below) of the electrode box 4 and the stem portion 23 and project toward the outside of the housing 2. The power supply pins 31 and 31 are erected and fixed to the stem portion 23. The two power supply pins 31 and 31 are electrically connected to a high frequency power supply H (to be described below) and a constant voltage power supply C1 (to be described below), respectively.

The electrode box 4 functions as a discharge path limiting member that limits a discharge path of the electrons emitted from the internal electrode 3, and is provided around an electron emission source accommodation space ER that accommodates the internal electrode 3. The electrode box 4 includes a surrounding portion 41, and the bottom lid 42. The surrounding portion 41 includes a cylindrical body portion 41*c* including a sidewall extending in an optical axis direction (to be described below), and a circular plate-shaped lid portion 41*b* extending in directions along the light transmission area 21*a*. The body portion 41*c* surrounds the internal electrode 3 when viewed from the optical axis direction. The lid portion 41*b* is connected to an end portion of the body portion 41*c* on the light transmission area 21*a* side. In this embodiment, the lid portion 41*b* and the body portion 41*c* are integrally formed. The lid portion 41*b* is disposed between the internal electrode 3 and the light transmission area 21*a*. The bottom lid 42 assumes a circular plate shape and is interpolated into the other end portion of the body portion 41*c* of the surrounding portion 41.

The surrounding portion 41 and the bottom lid 42 are disposed coaxially with the housing 2 to surround the internal electrode 3. The surrounding portion 41 and the bottom lid 42 separate the internal electrode 3 and the light transmission area 21*a*, in the discharge-gas-filled space, and are provided around the electron emission source accommodation space ER. A substantially circular electron passage hole 41*a* that causes the electrons emitted from the internal electrode 3 to pass is provided in a predetermined area, including a substantially central portion of the lid portion 41*b*, that is, a circumferentially central portion when the lid portion 41*b* has the circular plate shape. Further, a virtual line passing through the light transmission area 21*a* and the substantially central portion of the electron passage hole 41*a* is an optical axis Z, and an extending direction of the optical axis Z is an optical axis direction. In other words, the optical axis direction is a direction in which the light transmission area 21*a* and the electron emission source 3 face one another. A size (diameter) of the electron passage hole 41*a* in a direction intersecting the optical axis Z is smaller than a size (diameter) of the light transmission area 21*a* in the same direction, and smaller than a size (length) of the internal electrode 3 in a longitudinal direction (extending direction) in the same direction.

Figure 3:
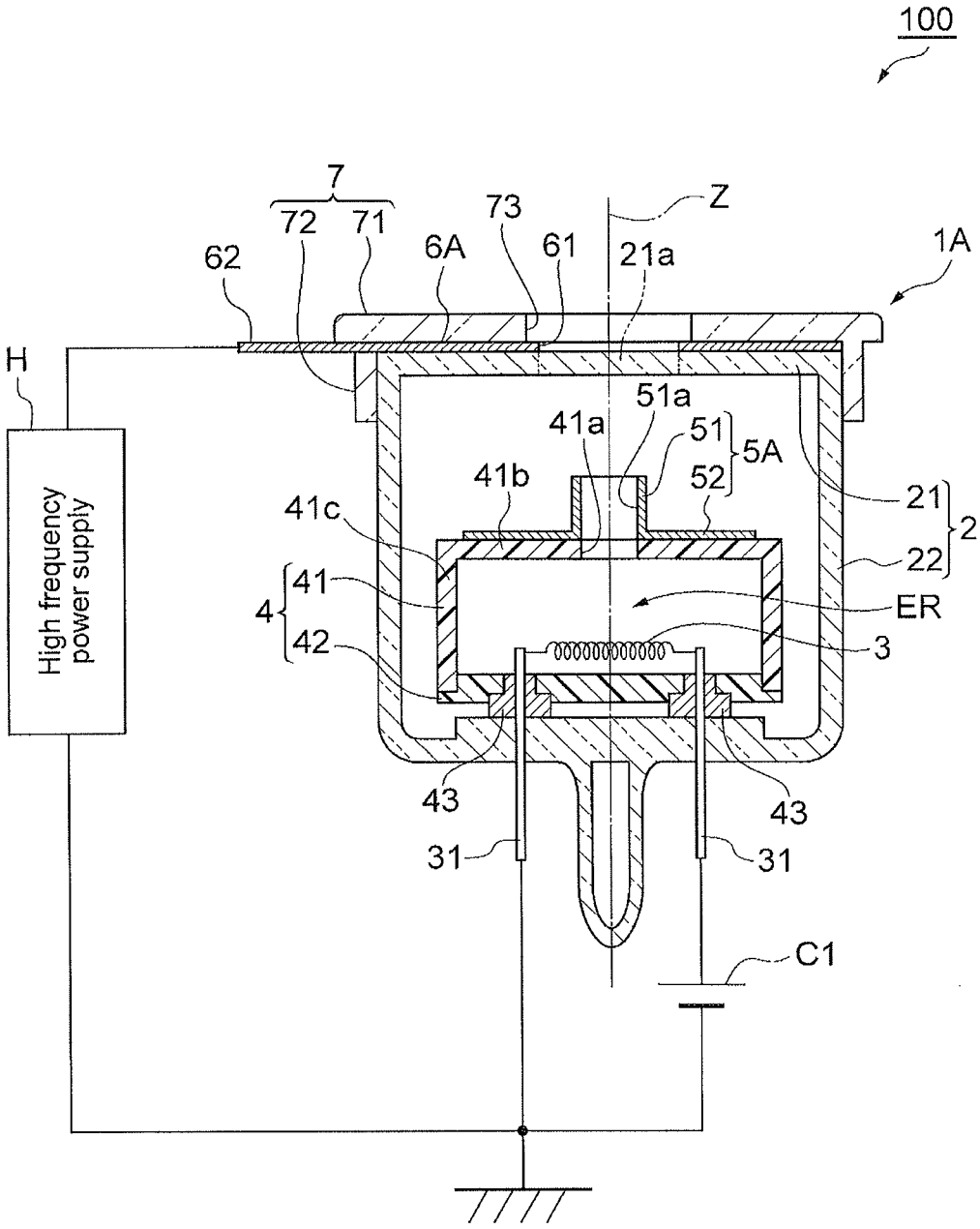
FIG. 3 is a schematic configuration diagram illustrating an example of a photoelectric device including the discharge lamp of FIG. 1.

Spacers 43 and 43 are interposed between the bottom lid 42 and the main body portion 22 (see FIG. 3). The spacer 43 assumes a cylindrical shape such that a section along the axis direction of the spacer 43 assumes a substantially ⊔ shape. The spacer 43 is slipped over the power supply pin 31 and interposed between the power supply pin 31 and a through hole of the bottom lid 42. The surrounding portion 41, the bottom lid 42 and the spacer 43 are formed of, for example, an insulating material such as a ceramic. Therefore, the surrounding portion 41, the bottom lid 42, and the spacer 43 can electrically and thermally block the electron emission source accommodation space ER from the space in the housing 2 around the electron emission source accommodation space ER, and contribute to a stable operation of the internal electrode 3. Further, since the bottom lid 42 is provided, the electrons emitted from the internal electrode 3 can be suppressed from going around from an end portion on the stem portion 23 side of the surrounding portion 41 to the dielectric portion 21. Therefore, the electrons are easily concentrated on the aperture 5A.

The aperture 5A functions as a discharge path narrowing member that further extends a narrowed area of the discharge path limited by the electron passage hole 41*a*. Further, the aperture 5A functions as a protection member that protects a peripheral edge portion of the electron passage hole 41*a* and the vicinity thereof. The aperture 5A includes a cylindrical portion (tubular portion) 51 having a cylindrical shape, and a flange portion 52 having an annular shape projecting radially outward from one end portion of the cylindrical portion 51. Both ends of the cylindrical portion 51 open, and a narrowing hole 51*a* penetrates into the cylindrical portion. An inner diameter of the narrowing hole 51*a* is substantially the same as that of the electron passage hole 41*a*, and a size (diameter) of the narrowing hole 51*a* in a direction intersecting the optical axis Z is smaller than a size (diameter) of the light transmission area 21*a* in the same direction and smaller than a size (length) of the internal electrode 3 in a longitudinal direction (extending direction) in the same direction. The cylindrical portion 51 is disposed to communicate with the electron passage hole 41*a* with being aligned on the same axis. That is, the cylindrical portion 51 is disposed on the optical axis Z. The flange portion 52 is in contact with a surface on the light transmission area 21*a* side of the lid portion 41*b*.

The two fixing pins 53 and 53 in a shaft shape pass through the flange portion 52, the lid portion 41*b*, the bottom lid 42, and the stem portion 23. The fixing pin 53 formed of a conductive member is fixed to the stem portion 23. A cylindrical fastener 54 of which a section along the axis direction assumes substantially a ⊔ shape is slipped over the one end of the fixing pin 53. The other end of the fixing pin 53 projects toward the outside of the housing 2. The aperture 5A is interposed between the lid portion 41*b* and the fastener 54. A sleeve 55 formed of a cylindrical insulating material is slipped over the fixing pin 53 between the lid portion 41*b* and the stem portion 23. The sleeve 55 is interposed between the fixing pin 53 and the bottom lid 42. The aperture 5A is formed of a material having a higher melting point than that of the material forming the electrode box 4. For example, the aperture 5A is formed of a high melting point metal such as molybdenum or tungsten, an alloy thereof, or a compound thereof. The fixing pin 53 is formed of, for example, a material having a thermal expansion coefficient close to that of a constituent material of the stem portion 23, such as Kovar metal. The fastener 54 is formed of, for example, a metal such as nickel. The sleeve 55 is formed of, for example, a ceramic.

The aperture 5A is fixed onto the lid portion 41 by caulking the fastener 54 to be fixed in a predetermined position of the fixing pin 53 and being pressed through the fastener 54 and the fixing pin 53 in a predetermined position on the lid portion 41*b*. Further, the surrounding portion 41 is fixed, as the entire electrode box 4, to the stem portion 23 by fixing the fastener 54 and being pressed to the bottom lid 42. Further, since the fixing pins 53 are covered with the sleeves 55, the fixing pins 53 are not exposed to the electron emitting portion accommodation space ER. Therefore, failure such as discharge between the fixing pins 53 and the internal electrode 3 is suppressed. Further, the number of fixing pins 53 may be 1 or 3 or more as long as the aperture 5A or the like is sufficiently fixed. Further, since the fixing pins 53 are at a floating potential and do not receive power supply, the fixing pins 53 are not limited to the conductive member and may be formed of an insulation material as long as the fixing pins 53 can reliably fix each component.

The external electrode 6A functions as an anode when the discharge occurs. The external electrode 6A is formed of a plate-shaped conductive member that assumes a substantially annular shape. An opening 61 is provided in a predetermined area, including a substantially central portion of the external electrode 6A, that is, a circumferentially central portion when the external electrode 6A has the substantially annular shape. A terminal 62 electrically connected to the high frequency power supply H (to be described below) extends radially outward from a predetermined place of an outer peripheral edge of the external electrode 6A. The external electrode 6A is formed of, for example, a metal such as nickel or aluminum.

The external electrode 6A is disposed at the outer side of the housing 2 to face the internal electrode 3 across the dielectric portion 21. Specifically, the external electrode 6A is disposed coaxially with the housing 2. The opening 61 is disposed on the optical axis Z and passes the light transmitted through the light transmission area 21*a*. That is, the internal electrode 3, the electron passage hole 41*a*, the narrowing hole 51*a*, the light transmission area 21*a*, and the opening 61 are disposed coaxially on the optical axis Z. Further, substantially the entire surface on the dielectric portion 21 side of the external electrode 6A except for the terminal 62 is in contact with the dielectric portion 21 in a planar shape.

The cover 7 is a member for fixing the external electrode 6A to the dielectric portion 21. The cover 7 includes an insulating member. The cover 7 includes an interposing portion 71 having an annular shape extending to face the dielectric portion 21, and a slip-over portion 72 of a substantially cylindrical shape projecting in a direction along the barrel portion 24 from the vicinity of an outer peripheral edge of a surface on the dielectric portion 21 side of the interposing portion 71. The slip-over portion 72 is slipped over the housing 2 so that the external electrode 6A is interposed between the interposing portion 71 and the dielectric portion 21 and fixed to the housing 2 by an adhesive or the like in this state. Thus, the external electrode 6A and the dielectric portion 21 are in close contact with each other. A notch for pulling out the terminal 62 of the external electrode 6A is provided in the slip-over portion 72. An opening 73 is provided in a predetermined area, including the substantially central portion of the interposing portion 71, that is, a circumferentially central portion when the interposing portion 71 has the annular shape. The opening 73 is disposed on the optical axis Z, and causes light transmitted through the opening 61 of the external electrode 6A to be emitted to the outside of the discharge lamp 1A. That is, the internal electrode 3, the electron passage hole 41*a*, the narrowing hole 51*a*, the light transmission area 21*a*, the opening 61, and the opening 73 are coaxially disposed on the optical axis Z. The cover 7 is formed of, for example, a ceramic.

FIG. 3 is a schematic configuration diagram illustrating an example of a photoelectric device including the discharge lamp of FIG. 1. A light source device 100 includes the discharge lamp 1A, as illustrated in FIG. 3. The light source device 100 is a device used for, for example, environmental measurement. The light source device 100 includes a high frequency power supply H and a constant voltage power supply C1, in addition to the discharge lamp 1A.

The high frequency power supply H is an AC power supply that supplies an AC current between the internal electrode 3 and the external electrode 6A, and is electrically connected to both the power supply pins 31 and 31 and the terminal 62 of the external electrode 6A. A frequency of the AC current supplied from the high frequency power supply H is, for example, about 10 kHz to about 2.45 GHz. A peak voltage of the AC current supplied from the high frequency power supply H is, for example, several V to tens of kV. The constant voltage power supply C1 is a heating DC power supply that heats the internal electrode 3, and is electrically connected to both of the power supply pins 31 and 31. The high frequency power supply H and the constant voltage power supply C1 have a common ground path.

In the discharge lamp 1A and the light source device 100 as described above, a DC current is supplied from the constant voltage power supply C1 to the internal electrode 3, and the internal electrode 3 is heated. In this state, the AC current from the high frequency power supply H is supplied between the internal electrode 3 disposed inside the discharge-gas-filled space of the housing 2 and the external electrode 6A disposed outside the housing 2. When the AC current is supplied, dielectric polarization occurs in the dielectric portion 21. Thermal electrons emitted from the heated internal electrode 3 form discharge between the internal electrode 3 and the dielectric portion 21. The discharge converges in the electron passage hole 41*a* and the narrowing hole 51*a* of the aperture 5A, and point-shaped discharge emission occurs. Light generated due to the discharge emission passes through the light transmission area 21*a*, the opening 61 of the external electrode 6A, and the opening 73 of the cover 7 and is emitted toward the outside of the discharge lamp 1A. Thus, in the discharge lamp 1A and the light source device 100, since the electrons are emitted in the discharge gas from the internal electrode 3 disposed in the discharge-gas-filled space while the dielectric polarization occurs, sufficient current density is obtained. Further, since the internal electrode 3 and the external electrode 6A connected to the high frequency power supply H are separately disposed inside and outside of the housing 2, withstand voltage performance between the discharge electrodes is high. Therefore, it is possible to perform a stable operation in which failure such as creeping discharge does not occur. Further, the discharge lamp 1A can be turned on within a relatively short period of time.

In the discharge lamp 1A, the external electrode 6A is in contact with the dielectric portion 21. Therefore, the dielectric polarization suitably occurs, and a stable discharge state is maintained. Therefore, it is possible to perform a more stable operation.

In the discharge lamp 1A, the internal electrode 3 includes the base that conducts an electric current, and the electron emitting portion provided on an outer surface of the base, and the electron emitting portion is formed of an easily electron-emitting substance such as barium oxide that emits electrons more easily than, for example, tungsten forming the base. Therefore, since the electrons are emitted from the electron emitting portion formed of the easily electron-emitting substance, the electrons are more reliably emitted than when electrons are emitted from the base. Therefore, it is possible to obtain more sufficient current density.

In the discharge lamp 1A, the electrode box 4 includes the body portion 41*c* and the lid portion 41*b* provided around the electron emission source accommodation space ER that accommodates the internal electrode 3. The body portion 41*c* assumes a wall shape surrounding the internal electrode 3 when viewed from a direction in which the internal electrode 3 and the light transmission area 21*a* face one another, the lid portion 41*b* is connected to an end portion on the light transmission area 21*a* side of the body portion 41*c*, and the electron passage hole 41*a* is provided in the lid portion 41*b*. Therefore, it is possible to prevent the electrons emitted from the internal electrode 3 from being incident on the main body portion 22 and the like. Therefore, it is possible to perform a more stable operation. In this embodiment, the body portion 41*c* assumes a cylindrical shape.

The discharge lamp 1A includes the aperture 5A formed of, for example, a high melting point metal, an alloy thereof, or a compound thereof having a higher melting point than that of, for example, the ceramic forming the electrode box 4, and the narrowing hole 51*a* is provided in the aperture 5A. The aperture 5A is attached to a surface on the light transmission area 21*a* side of the lid portion 41*b* of the electrode box 4 so that the narrowing hole 51*a* and the electron passage hole 41*a* communicate. Therefore, a peripheral edge portion of the electron passage hole 41*a* and the vicinity thereof that easily deteriorate due to the discharge in the electrode box 4 can be protected by the aperture 5A. Therefore, the discharge path can be kept in a stable state and a more stable operation can be performed.

In the discharge lamp 1A, the cylindrical portion 51 that is attached to the electrode box 4 and of which the inside communicates with the electron passage hole 41*a* is provided, and the cylindrical portion 51 projects toward the light transmission area 21*a*. Therefore, a higher current density can be obtained in the cylindrical portion 51.

In the discharge lamp 1A, the electrons emitted from the internal electrode 3 converge in the electron passage hole 41*a* and the narrowing hole 51*a* of the aperture 5A, and discharge emission occurs. Thus, the electron discharge path is narrowed by the aperture 5A, and thus high luminance can be achieved.

The discharge lamp 1A includes the cover 7 fixed to the housing 2 to cover the dielectric portion 21, and the external electrode 6A is sandwiched between the cover 7 and the dielectric portion 21. Accordingly, the external electrode 6A and the dielectric portion 21 are in close contact with each other, and a stable discharge state is maintained. Therefore, it is possible to perform a more stable operation.

In the discharge lamp 1A, the internal electrode 3 is a thermionic emission source that emits thermal electrons. Therefore, electrons can be suitably supplied, and thus it is possible to perform a more stable operation.

The light source device 100 includes the discharge lamp 1A, the high frequency power supply H that supplies the AC current between the internal electrode 3 and the external electrode 6A, and the constant voltage power supply C1 that heats the internal electrode 3. Therefore, since the thermal electrons are emitted from the heated internal electrode 3, the electrons can be stably supplied. Therefore, it is possible to perform a more stable operation.

Second Embodiment

Figure 4:
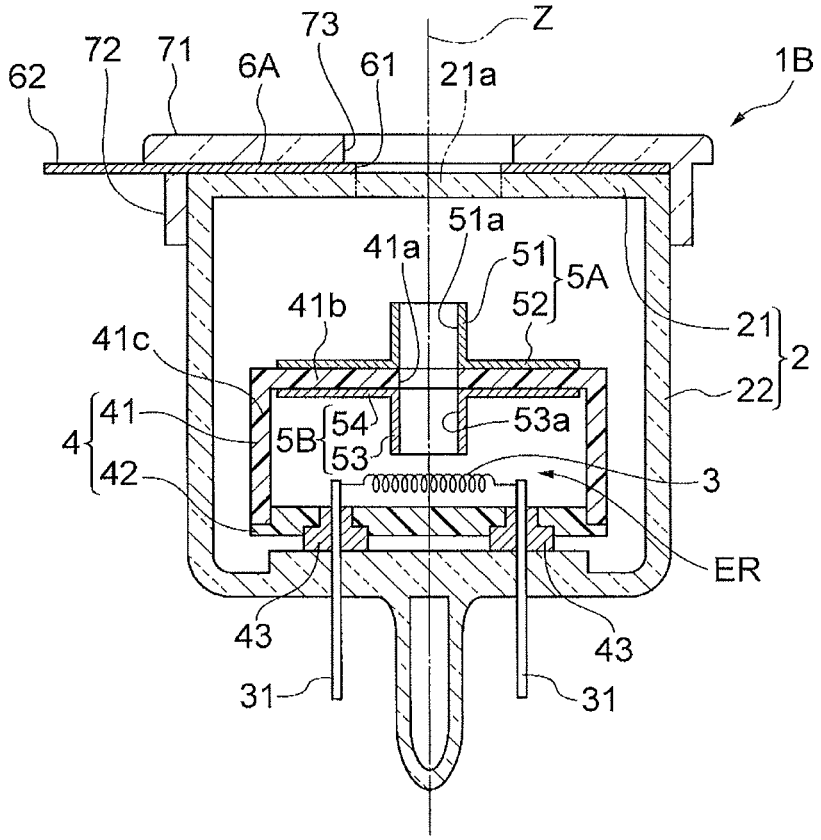
FIG. 4 is a cross-sectional view illustrating a discharge lamp of a second embodiment.

FIG. 4 is a cross-sectional view illustrating a discharge lamp of a second embodiment. The discharge lamp 1B of this embodiment and the discharge lamp 1A of the first embodiment are different in that an aperture 5B is attached to an inner side of an electrode box 4.

The aperture 5B has the same structure as the aperture 5A of the first embodiment, and includes a cylindrical portion (tubular portion) 53 and a flange portion 54. The aperture 5B functions as a protection member that protects a peripheral edge portion of the electron passage hole 41*a* and the vicinity thereof, in addition to functioning as a discharge path narrowing member. A narrowing hole 53*a* of the cylindrical portion 53 is aligned coaxially with the electron passage hole 41*a*, that is, disposed on an optical axis Z. The flange portion 52 of the aperture 5B is in contact with a surface on the internal electrode 3 side of the lid portion 41*b*. That is, the aperture 5B is attached to the surface on the internal electrode 3 side of the lid portion 41*b* so that the narrowing hole 53*a* of the cylindrical portion 53 and the electron passage hole 41*a* communicate. For example, the attachment of the flange portion 52 of the aperture 5B to the surrounding portion 41 can be realized by being interposed between the sleeve 55 slipped over the fixing pin 53 and the surface on the internal electrode 3 side of the lid portion 41*b* and caulking the fastener 54, as in the attachment of the flange portion 52 of the aperture 5A to the surrounding portion 41.

In the discharge lamp 1B as described above, a DC current is supplied to the internal electrode 3, and the internal electrode 3 is heated. In this state, when an AC current is supplied between the internal electrode 3 and the external electrode 6A, dielectric polarization occurs in the dielectric portion 21. Electrons are emitted in the discharge gas from the internal electrode 3, and discharge is formed between the internal electrode 3 and the dielectric portion 21. The discharge converges in the narrowing hole 53*a* of the aperture 5B, the electron passage hole 41*a*, and the narrowing hole 51*a* of the aperture 5A, and point-shaped discharge emission occurs. Light generated due to the discharge emission passes through the light transmission area 21*a*, an opening 61 of the external electrode 6A and an opening 73 of the cover 7, and is emitted to the outside of the discharge lamp 1B.

Such a discharge lamp 1B has the same effects as the discharge lamp 1A of the first embodiment. Further, the discharge lamp 1B includes the aperture 5B formed of, for example, a high melting point metal, an alloy thereof, or a compound thereof having a higher melting point than that of, for example, the ceramic forming the electrode box 4, and the narrowing hole 53*a* is provided. The aperture 5B is attached to the surface on the internal electrode 3 side of the lid portion 41*b* of the electrode box 4 so that the narrowing hole 53*a* and the electron passage hole 41*a* communicate. Therefore, the peripheral edge portion of the electron passage hole 41*a* and the vicinity thereof that easily deteriorate due to the discharge in the electrode box 4 can be further protected by the aperture 5B, and the discharge path is kept in a stable state. Therefore, it is possible to perform a more stable operation.

In the discharge lamp 1B, the cylindrical portion 53 that is attached to the electrode box 4 and of which the inside communicates with the electron passage hole 41*a* is provided, and the cylindrical portion 53 projects toward the internal electrode 3. Therefore, it is possible to further increase current density in the cylindrical portion 53.

Further, in the discharge lamp 1B, the electrons emitted from the internal electrode 3 converge in the narrowing hole 53*a* of the aperture 5B, the electron passage hole 41*a*, and the narrowing hole 51*a* of the aperture 5A, and the discharge emission occurs. Thus, since the discharge path of electrons is narrowed by both the aperture 5A and the aperture 5B, higher luminance can be achieved.

Third Embodiment

Figure 5:
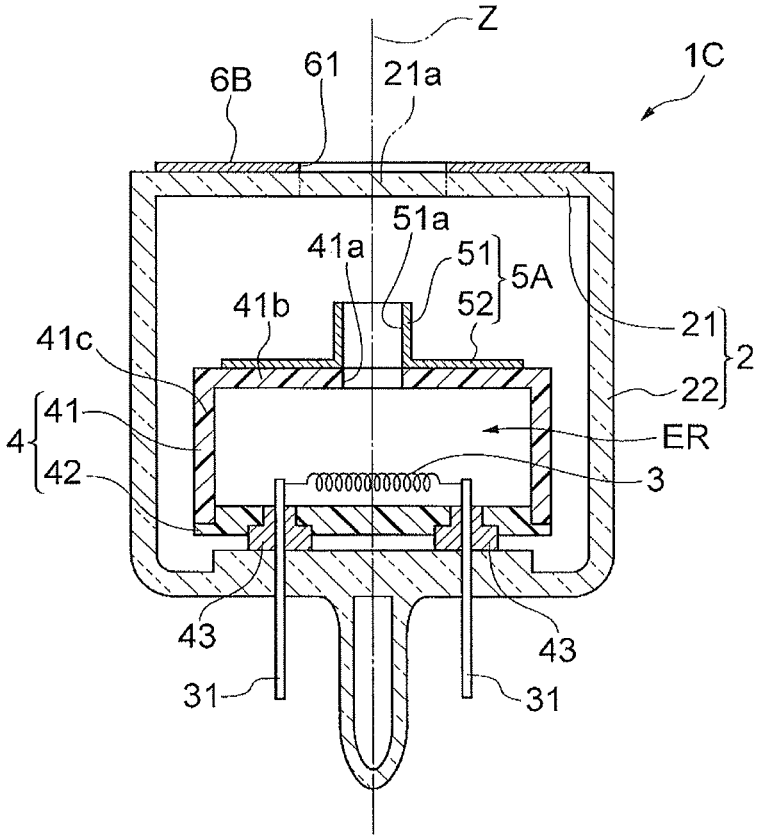
FIG. 5 is a cross-sectional view illustrating a discharge lamp of a third embodiment.

FIG. 5 is a cross-sectional view illustrating a discharge lamp of a third embodiment. A discharge lamp 1C of this embodiment and the discharge lamp 1A of the first embodiment are different in that an external electrode 6B is fixed to a dielectric portion 21 without using a cover.

The external electrode 6B assumes an annular shape. The external electrode 6B is formed by depositing, for example, a metal such as nickel or aluminum on an outer surface of the dielectric portion 21, and is formed of a conductive film. The external electrode 6B is disposed coaxially with a housing 2, as in the external electrode 6A.

In the discharge lamp 1C as described above, a DC current is supplied to the internal electrode 3, and the internal electrode 3 is heated. In this state, when an AC current is supplied between the internal electrode 3 and the external electrode 6B, dielectric polarization occurs in the dielectric portion 21. Electrons are emitted in a discharge gas from the internal electrode 3, and discharge is formed between the internal electrode 3 and the dielectric portion 21. The discharge converges in the electron passage hole 41*a* and a narrowing hole 51*a*, and point-shaped discharge emission occurs. Light generated due to the discharge emission passes through the light transmission area 21*a* and an opening 61 of the external electrode 6B and is emitted to the outside of the discharge lamp 1C.

Such a discharge lamp 1C has the same effects as the discharge lamp 1A of the first embodiment. Further, in the discharge lamp 1C, it is possible to achieve improvement of close contact with the dielectric portion 21, reduction of number of parts, and miniaturization of the device since the external electrode 6B is fixed to the dielectric portion 21 through deposition or the like without using the cover.

Fourth Embodiment

Figure 6:
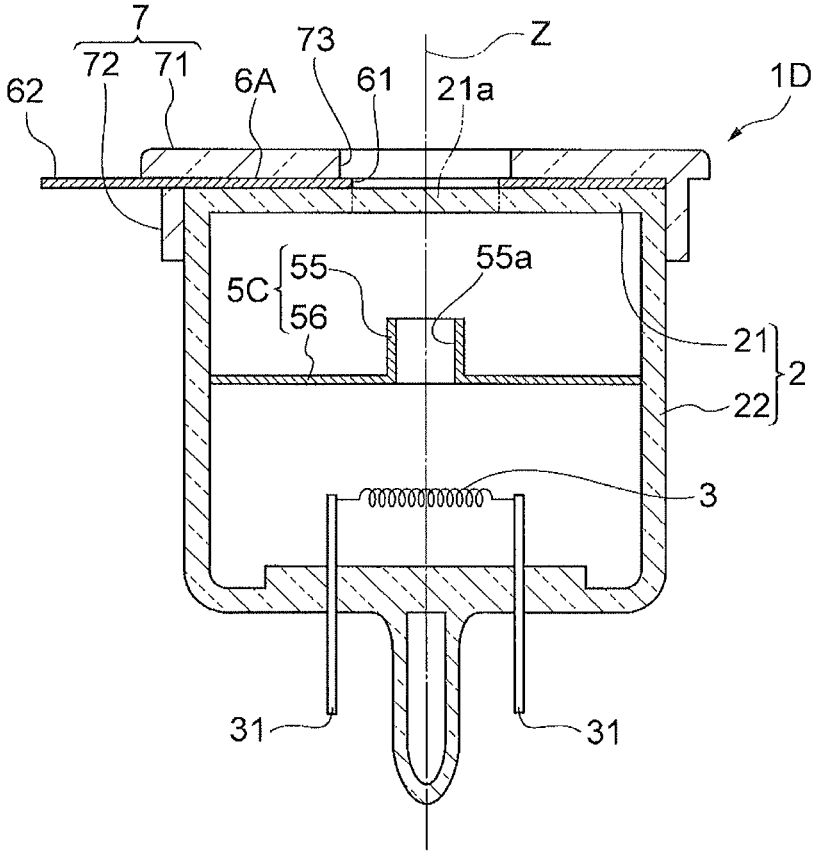
FIG. 6 is a cross-sectional view illustrating a discharge lamp of a fourth embodiment.

FIG. 6 is a cross-sectional view illustrating a discharge lamp of a fourth embodiment. A discharge lamp 1D of this embodiment includes an aperture 5C in addition to a housing 2, an internal electrode 3, an external electrode 6A, and a cover 7.

The aperture 5C functions as a discharge path limiting member having an electron passage hole that limits a discharge path of electrons emitted from the internal electrode 3. The aperture 5C includes a cylindrical portion 55, and a flange portion 56 that projects radially outward from one end portion of the cylindrical portion 55. A through-hole 55*a* formed in the cylindrical portion 55 functions as an electron passage hole that passes the electrons emitted from the internal electrode 3 like the above-described electron passage hole 41*a*, and functions as a narrowing hole that narrows the discharge path like the above-described narrowing hole 51*a*. The aperture 5C is disposed between the internal electrode 3 and a light transmission area 21*a* in the discharge-gas-filled space, and separates the internal electrode 3 and the light transmission area 21*a*. An outer diameter of the flange portion 56 is substantially the same as the inner diameter of a barrel portion 24. An outer peripheral edge of the flange portion 56 is fixed to an inner peripheral surface of the barrel portion 24, for example, using fusion bonding or an adhesive. The aperture 5C is formed of, for example, a high melting point metal such as molybdenum or tungsten, an alloy thereof, or a compound thereof.

In the discharge lamp 1D as described above, a DC current is supplied to the internal electrode 3, and the internal electrode 3 is heated. In this state, when an AC current is supplied between the internal electrode 3 and the external electrode 6A, dielectric polarization occurs in the dielectric portion 21. Electrons are emitted in a discharge gas from the internal electrode 3, and discharge is formed between the internal electrode 3 and the dielectric portion 21. The discharge converges in the through-hole 55*a* of the aperture 5C, and a point-shaped discharge emission occurs. Light generated due to the discharge emission passes through the light transmission area 21*a*, an opening 61 of the external electrode 6A, and an opening 73 of the cover 7 and is emitted to the outside of the discharge lamp 1D.

Such a discharge lamp 1D has the same effects as the discharge lamp 1A of the first embodiment. Further, in the discharge lamp 1D, since the aperture 5C functioning as the discharge path limiting member is directly fixed to the housing 2, a part such as the electrode box 4 can be removed. Therefore, it is possible to achieve reduction of number of parts and reduction of a manufacturing cost.

Fifth Embodiment

Figure 7:
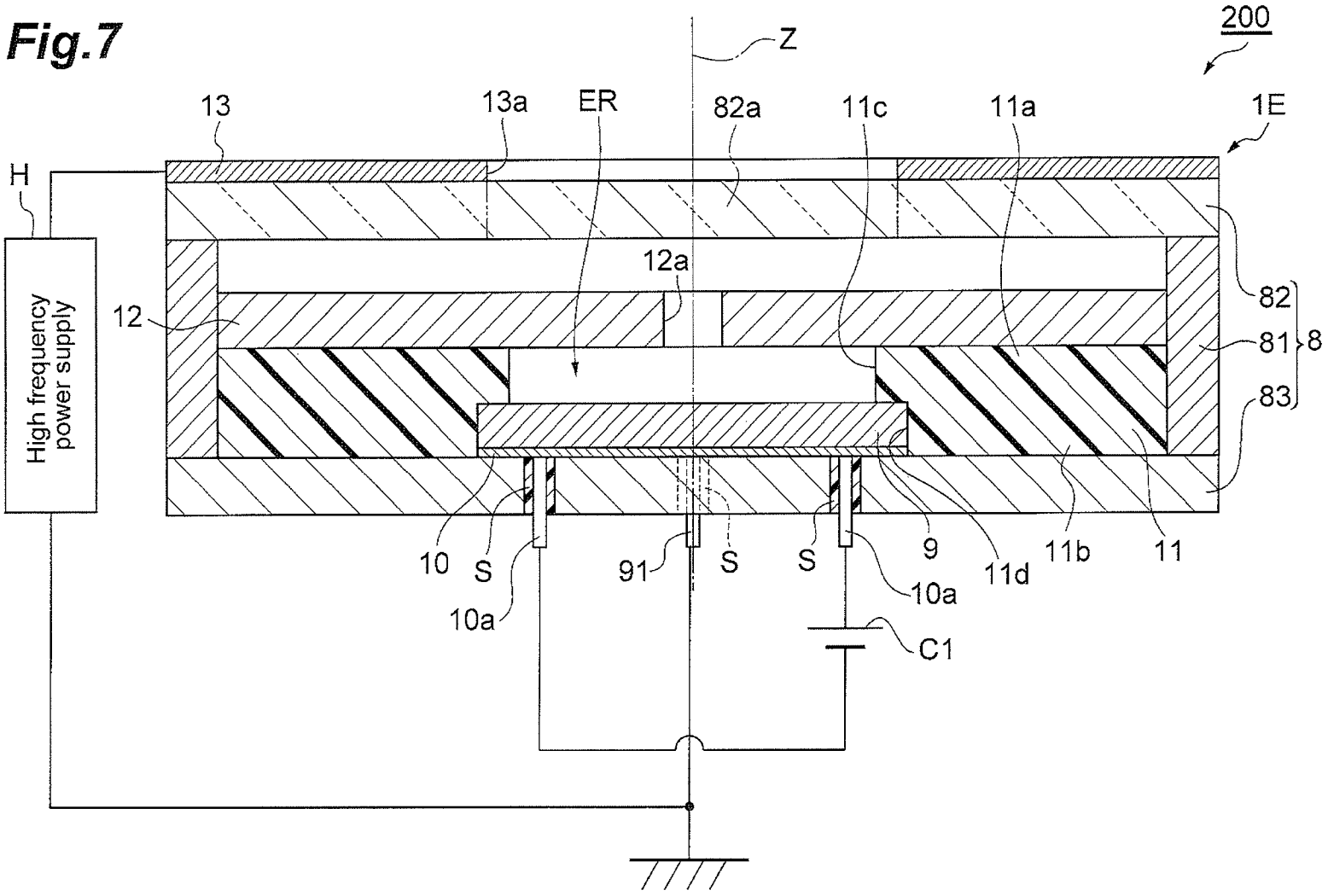
FIG. 7 is a schematic configuration diagram illustrating an example of a light source device including a discharge lamp of a fifth embodiment.

FIG. 7 is a schematic configuration diagram illustrating an example of a light source device including a discharge lamp of a fifth embodiment. A discharge lamp 1E of this embodiment has a flat shape in which an external form is a polygon or circle, and has a plate-shaped structure in which a length (thickness) in a light emission direction is smaller than a length (width) in a direction perpendicular to the emission direction. The discharge lamp 1E includes a housing 8, an internal electrode 9, a heater 10, an insulator 11, an aperture 12, and an external electrode 13.

The housing 8 is a container that contains a discharge gas, and the inside of the housing 8 is a discharge-gas-filled space filled with the discharge gas. The housing 8 includes a tubular barrel portion 81, a plate-shaped window material 82 that closes one end portion of the barrel portion 81, and a plate-shaped stem portion 83 that closes the other end portion of the barrel portion 81.

The window material 82 functions as a dielectric portion that generates dielectric polarization and transmits light generated inside the housing 8 to the outside. The window material 82 is formed of a dielectric material having a light transmission characteristic with respect to the light generated in the housing 8, and for example, is formed of any glass or ceramic. The window material 82 is a plate-shaped member. A predetermined area including a substantially central portion in the dielectric portion 21 is a substantially circular light transmission area 82*a* that is a light emitting window that transmits the light generated in the discharge-gas-filled space.

The barrel portion 81 and the stem portion 83 function as a main body portion forming the discharge-gas-filled space together with the window material 82. The barrel portion 81 and the stem portion 83 are formed of a conductive material such as a metal or an insulating material such as glass or a ceramic. For example, the barrel portion 81 may be formed of a metal such as indium, and the stem portion 83 may be formed of a metal, glass, or a ceramic.

The internal electrode 9 is a thermionic emission source that emits thermal electrons to the discharge-gas-filled space, and functions as a hot cathode when the discharge occurs. The internal electrode 9 is stacked on a surface on the discharge-gas-filled space side of the stem portion 83 via the heater 10, in the discharge-gas-filled space, and faces the light transmission area 82*a*.

The internal electrode 9 assumes a flat plate shape extending in directions along the light transmission area 82*a*. The internal electrode 9 includes a base that is a plate-shaped member or a film-shaped member formed of a conductive member, and an electron emitting portion provided on an outer surface of the base facing the light transmission area 82*a*. The electron emitting portion is formed, for example, by applying an easily electron-emitting substance such as barium oxide to the base. One end of a cathode power supply pin 91 formed of a conductive member is connected to the internal electrode 9. The other end portion of the cathode power supply pin 91 passes through the stem portion 83 and projects toward the outside of the housing 8. The cathode power supply pin 91 is electrically connected to a high frequency power supply H. Further, when the stem portion 83 is formed of an insulating material, the cathode power supply pin 91 is directly held by the stem portion 83. On the other hand, when the stem portion 83 is formed of a metal, a spacer S (for example, a hermetic seal) formed of an insulating material is interposed between the cathode power supply pin 91 and the stem portion 83.

The heater 10 is a heating source that heats the internal electrode 9. The heater 10 assumes a flat shape to be able to be in close contact with the internal electrode 9, and is interposed between the internal electrode 9 and the stem portion 83. The heater 10 is formed, for example, by disposing linear members formed of a high melting point metal such as tungsten in a planar shape. One end of each of a pair of heater power supply pins 10*a* and 10*a* formed of a conductive member is connected to the heater 10. The other end of each heater power supply pin 10*a* penetrates the stem portion 83 and projects to the outside of the housing 8. The heater power supply pins 10*a* are connected to the constant voltage power supply C1. Further, when the stem portion 83 is formed of a metal, a spacer S is interposed between the heater power supply pin 31*a* and the stem portion 83, as in the cathode power supply pin 91.

The insulator 11 functions as a discharge path limiting member that electrically insulates between the housing 8 and the internal electrode 9 and limits the discharge path of the electrons emitted from the internal electrode 9. The insulator 11 assumes a substantially tubular shape, and is inserted into the barrel portion 81 so that an outer surface of the insulator 11 is in contact with an inner surface of the barrel portion 81. The insulator 11 is stacked on the stem portion 83. The insulator 11 includes a lid portion 11*a* on the light transmission area 82*a* side, and a body portion 11*b* on the stem portion 83 side. The body portion 11*b* surrounds the internal electrode 9 when viewed from an optical axis direction (to be described below). The lid portion 11*a* is connected to an end portion on the light transmission area 82*a* side of the body portion 11*b*. An inner surface 11*c* of the lid portion 11*a* is smaller than an inner surface 11*d* of the body portion 11*b*, and a marginal region of the internal electrode 9 is interposed between a surface on the stem portion 83 side of the lid portion 11*a* and the stem portion 83. Thus, an electron emission source accommodation space ER that accommodates the internal electrode 9 is provided by the lid portion 11*a* and the body portion 11*b*. The inner surface 11*c* of the lid portion 11*a* functions as an electron passage hole that passes the electrons emitted from the internal electrode 9. The insulator 11 is formed of, for example, an insulating material such as glass or a ceramic.

The aperture 12 functions as a discharge path narrowing member that further narrows the discharge path limited by the inner surface 11*c* of the lid portion 11*a*, and functions as a protection member that protects the inner surface 11*c* of the lid portion 11*a* and the vicinity thereof. The aperture 12 assumes a substantially flat plate shape (face plate shape) extending in directions along the light transmission area 82*a*, and is inserted into the barrel portion 81 so that an outer surface thereof is in contact with an inner surface of the barrel portion 81. The aperture 12 is stacked on a surface on the light transmission area 82*a* side of the insulator 11. A narrowing hole 12*a* having a substantially circular shape that passes the electrons emitted from the internal electrode 9 is provided in a predetermined area, including a substantially central portion of the aperture 12. The aperture 12 is disposed so that the inner surface 11*c* of the lid portion 11*a* and the narrowing hole 12*a* communicate. The aperture 12 is formed of, for example, a high melting point metal such as molybdenum or tungsten, an alloy thereof, or a compound thereof, and can protect the insulator 11 at the time of discharge. Further, the aperture 12 may be formed, for example, of the same material as the insulator 11 and integrally with the insulator 11. In this case, for example, a protection member formed of a high melting point metal such as molybdenum or tungsten, an alloy thereof, or a compound thereof on the surface on the light transmission area 82*a* side of the aperture 12 may be further disposed. Further, a virtual line passing through a substantially central portion of the light transmission area 82*a* and the narrowing hole 12*a* is an optical axis Z, and an extending direction of the optical axis Z is an optical axis direction. In other words, the optical axis direction is a direction in which the internal electrode 9 and the light transmission area 82*a* face one another. A size (diameter) of the narrowing hole 12*a* in a direction intersecting the optical axis Z is smaller than a size (diameter) of the light transmission area 82*a* in the same direction, a size (diameter) of the inner surface 11*c* in the same direction, and a size (length) of the internal electrode 9 in the same direction.

The external electrode 13 functions as an anode when the discharge occurs. The external electrode 13 is a flat plate-shaped conductive member formed by depositing, for example, a metal such as nickel or aluminum on the outer surface of the window material 82. The external electrode 13 is disposed at the outer side of the housing 8 to face the internal electrode 9 across the window material 82. A circular opening 13*a* formed in a predetermined area, including a substantially central portion of the external electrode 13, is disposed on the optical axis Z and passes the light transmitted through light transmission area 82*a*. That is, the internal electrode 9, the opening 11*a*, the narrowing hole 12*a*, the light transmission area 82*a*, and the opening 13*a* are coaxially disposed on the optical axis Z.

The light source device 200 including the discharge lamp 1E includes a high frequency power supply H and a constant voltage power supply C1 as described above. The high frequency power supply H is grounded. The constant voltage power supply C1 supplies an electric current to the heater 10, and the internal electrode 9 is heated using the heater 10.

In the discharge lamp 1E and the light source device 200 as described above, a DC current is supplied from the constant voltage power supply C1 to the heater 10, and the internal electrode 9 is heated using the heater 10. In this state, an AC current from the high frequency power supply H is supplied between the internal electrode 9 disposed in the discharge-gas-filled space on the inner side of the housing 8 and the external electrode 13 disposed at the outer side of the housing 8. When the AC current is supplied, dielectric polarization occurs in the window material 82. Thermal electrons emitted from the heated internal electrode 9 form discharge between the internal electrode 9 and the window material 82. The discharge converges in the narrowing hole 12*a*, and point-shaped discharge emission occurs. Light generated due to the discharge emission passes through the light transmission area 82*a* and the opening 13*a* of the external electrode 13 and is emitted to the outside of the discharge lamp 1E. Thus, in the discharge lamp 1E and the light source device 200, since the electrons are emitted in the discharge gas from the internal electrode 9 disposed in the discharge-gas-filled space while the dielectric polarization occurs, sufficient current density is obtained. Further, since the internal electrode 9 and the external electrode 13 connected to the high frequency power supply H are separately disposed inside and outside of the housing 8, withstand voltage performance between the discharge electrodes becomes high. Therefore, it is possible to perform a stable operation in which failure such as creeping discharge does not occur. Further, the discharge lamp 1E can be turned on within a relatively short period of time. Further, in the discharge lamp 1E, the internal electrode and the heater may be integrally configured to energize and heat the conductive material having an easily electron-emitting substance provided on an outer surface, as in the discharge lamp 1A of the first embodiment.

The discharge lamp 1E is configured by stacking main components such as the stem portion 83, the barrel portion 81, the heater 10, the internal electrode 9, the insulator 11, the aperture 12, the window material 82, and the external electrode 13. Therefore, the discharge lamp 1E can be easily manufactured and can be downsized. Particularly, in the discharge lamp 1E, a manufacturing method in which a plurality of discharge lamps 1E are integrally formed using a substrate including a plurality of portions corresponding to the window materials 82, and a substrate including a plurality of portions corresponding to the stem portions 83, and are cut into the discharge lamps 1E after the discharge gas is filled can be adopted.

In the discharge lamp 1E, the external electrode 13 is in contact with the window material 82. Therefore, dielectric polarization suitably occurs, and thus a stable discharge state is maintained. Therefore, it is possible to perform a more stable operation. Further, in the discharge lamp 1E, the external electrode 13 is fixed to the window material 82 through deposition without using a cover or the like, and thus it is possible to achieve improvement of close contact of the external electrode 13 with the window material 82, reduction of number of parts, and miniaturization of the device.

In the discharge lamp 1E, the internal electrode 9 includes a base that conducts an AC current, and an electron emitting portion provided on the outer surface of the base, and the electron emitting portion is formed of an easily electron-emitting substance such as barium oxide that emits electrons more easily than the tungsten or the like which forming the base. Accordingly, since the electrons are emitted from the electron emitting portion formed of the easily electron-emitting substance, the electrons are emitted more reliably than when electrons are emitted from the base. Therefore, it is possible to obtain more sufficient current density.

In the discharge lamp 1E, the insulator 11 includes the body portion 11*b* and the lid portion 11*a* surrounding the electron emission source accommodation space ER that accommodates the internal electrode 9, the body portion 11*b* assumes a wall shape surrounding the internal electrode 9 when viewed from a direction in which the internal electrode 9 and the light transmission area 82*a* face one another, the lid portion 11*a* is connected to the end portion on the light transmission area 82*a* side of the body portion 11*b*, and the inner surface 11*c* is provided as the electron passage hole. Therefore, the electrons emitted from the internal electrode 9 can be prevented from being incident on the barrel portion 81 and the like. Therefore, it is possible to perform a more stable operation.

The discharge lamp 1E includes the aperture 12 that is formed of, for example, a high melting point metal, an alloy thereof, or a compound thereof having a higher melting point than the ceramic forming the lid portion 11*a* of the insulator 11, and the narrowing hole 12*a* is provided in the aperture 12. The aperture 12 is attached to the surface on the light transmission area 82*a* side of the lid portion 11*a* so that the narrowing hole 12*a* and the inner surface 11*c* of the lid portion 11*a* communicate. Therefore, the inner surface 11*c* of the lid portion 11*a* and the vicinity thereof that easily deteriorate due to the discharge in the insulator 11 can be protected by the aperture 12. Therefore, the discharge path is kept in a stable state and a more stable operation can be performed.

In the discharge lamp 1E, the internal electrode 9 is a thermionic emission source that emits thermal electrons. Therefore, the electrons can be suitably supplied, and thus it is possible to perform a more stable operation.

The light source device 200 includes the discharge lamp 1E, the high frequency power supply H that supplies the AC current between the internal electrode 9 and the external electrode 13, and the constant voltage power supply C1 for heating the internal electrode 9 through the heater 10. Further, the discharge lamp 1E includes the heater 10 for heating the internal electrode 9. Therefore, since the thermal electrons are suitably emitted from the heated internal electrode 9, the electrons are emitted in a more stable manner. Therefore, it is possible to perform a more stable operation.

While the preferred embodiments of the discharge lamp and the light source device of the present invention have been described above, the present invention is not limited to the above-described embodiments. For example, in the discharge lamps 1A to 1D, while the dielectric portion 21 and the main body portion 22 are integrally formed of the same material, the dielectric portion 21 and the main body portion 22 may be formed of different materials.

While the internal electrodes 3 and 9 include the base formed of, for example, tungsten, and the electron emitting portion formed of the easily electron-emitting substance such as barium oxide, the electrons may be emitted through thermionic emission from the base without including the electron emitting portion. Further, instead of a directly heated type in which the internal electrode 3 itself is energized and heated by the constant voltage power supply C1, the internal electrode 3 may be an indirectly heated type in which the high frequency power supply H is connected to the internal electrode 3, a heater disposed near the internal electrode 3 to heat the internal electrode 3 is provided, and the constant voltage power supply C1 is connected to the heater, as in the internal electrode 9. Further, while the internal electrodes 3 and 9 are hot cathodes, the internal electrodes 3 and 9 may be cold cathodes.

While the external electrodes 6A and 6B are in contact with only the dielectric portion 21 in the housing 2, the external electrodes 6A and 6B may extend to cover the outer surface on the dielectric portion 21 side of the barrel portion 24 and come in contact with the barrel portion 24. In this case, high luminance can be achieved due to increase in an amount of discharge.

INDUSTRIAL APPLICABILITY

According to the present invention, it is possible to provide the discharge lamp and the light source device in which sufficient current density and high stability can be achieved.

REFERENCE SIGNS LIST

1A to 1E: Discharge lamp, 2: Housing, 3: Internal electrode, 4: Electrode box, 5A to 5C: Aperture, 6A and 6B: External electrode, 7: Cover, 8: Housing, 9: Internal electrode, 12: Aperture, 12*a*: Electron passage hole, 13: External electrode, 13*a*: Opening, 21: Dielectric portion, 21*a*: Light transmission area, 22: Main body portion, 41*a*: Electron passage hole, 61: Opening, 81: Barrel portion, 82: Window material, 82*a*: Light transmission area, 83: Stem portion, H: High frequency power supply, C1: Constant voltage power supply.

The invention claimed is:

1. A discharge lamp comprising:

a housing including a dielectric portion having a light transmission area formed of a dielectric material and transmitting light, and a main body portion forming a discharge-gas-filled space together with the dielectric portion, the discharge-gas-filled space being filled with a discharge gas;

an electron emission source disposed in the discharge-gas-filled space to face the light transmission area;

a discharge path limiting member separating the electron emission source and the light transmission area, in the discharge-gas-filled space, and including an electron passage hole that transmits electrons emitted from the electron emission source; and an external electrode disposed at an outer side of the housing to face the electron emission source across the dielectric portion, and including an opening that passes the light transmitted through the light transmission area.

2. The discharge lamp according to claim 1, wherein the external electrode is in contact with the dielectric portion.

3. The discharge lamp according to claim 1, wherein the electron emission source includes a base that conducts an electric current; and an electron emitting portion provided on an outer surface of the base, and the electron emitting portion is formed of an easily electron-emitting substance that emits electrons more easily than does a material forming the base.

4. The discharge lamp according to claim 1, wherein the discharge path limiting member includes a body portion and a lid portion provided around an electron emission source accommodation space that accommodates the electron emission source, the body portion assumes a wall shape surrounding the electron emission source when viewed from a direction in which the electron emission source and the light transmission area face one another, and the lid portion is connected to an end portion on the light transmission area side of the body portion, and includes the electron passage hole.

5. The discharge lamp according to claim 1, further comprising:

a protection member formed of a material having a higher melting point than a material forming the discharge path limiting member and including a through-hole, wherein the protection member is attached to the discharge path limiting member so that the through-hole and the electron passage hole communicate.

6. The discharge lamp according to claim 1, further comprising:

a tubular portion connected to the discharge path limiting member, the inside of the tubular portion communicating with the electron passage hole, wherein the tubular portion projects toward the light transmission area or the electron emission source.

7. The discharge lamp according to claim 1, further comprising:

a cover fixed to the housing to cover the dielectric portion, wherein the external electrode is interposed between the cover and the dielectric portion.

8. The discharge lamp according to claim 1, wherein the electron emission source is a thermionic emission source that emits thermal electrons.

9. A light source device comprising:

the discharge lamp according to claim 1; and an AC power supply that supplies an AC current between the electron emission source and the external electrode.

10. A light source device comprising:

the discharge lamp according to claim 8;

an AC power supply that supplies an AC current between the electron emission source and the external electrode; and a heating DC power supply that heats the electron emission source.

* * * * *